US006365258B1

(12) United States Patent
Alm

(10) Patent No.: US 6,365,258 B1
(45) **Date of Patent: *Apr. 2, 2002**

(54) METHOD OF FLOOR LAYING AND FLOCKED UNDERLAY AND FLOOR MATERIAL TO BE USED WITH THE METHOD

(75) Inventor: Kjell K. Alm, Göteborg (SE)

(73) Assignee: Flooron Aktiebolag, Ockero (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/944,290

(22) Filed: Oct. 6, 1997

Related U.S. Application Data

(63) Continuation of application No. 08/617,902, filed on Mar. 15, 1996, now abandoned.

(30) Foreign Application Priority Data

Sep. 16, 1993 (SE) ..... 9303035

(51) Int. Cl.[7] ..... E04F 15/02; E04F 15/16; B32B 3/14

(52) U.S. Cl. ..... 428/86; 428/88; 428/90; 428/95; 428/47; 428/48; 428/54; 428/55; 428/56; 428/58; 428/62; 428/82; 52/390; 52/391; 156/71; 156/304.7

(58) Field of Search ..... 428/90, 86, 93, 428/88, 44, 47, 48, 49, 50, 51, 52, 53, 54, 55, 56, 57, 58, 61, 62, 81, 82; 52/390, 391, 392, 403.1, 578, 582.1, 747.1, 747.11; 156/71, 299, 304.1, 304.5, 304.7, 304.4

(56) References Cited

U.S. PATENT DOCUMENTS

| | | | | | |
|---|---|---|---|---|---|
| 3,014,829 | A | * | 12/1961 | Curtain | |
| 3,528,874 | A | * | 9/1970 | Spencer | 428/90 |
| 3,533,892 | A | * | 10/1970 | Kantorowicz | 428/90 |
| 3,583,890 | A | * | 6/1971 | Kolckmann | 428/90 |
| 3,961,116 | A | * | 6/1976 | Klein | 428/90 |
| 4,076,878 | A | * | 2/1978 | Norby | 428/90 |
| 4,404,243 | A | * | 9/1983 | Terpay | 428/62 |
| 4,482,593 | A | | 11/1984 | Sagel et al. | |
| 4,515,845 | A | * | 5/1985 | Annis | 428/90 |
| 4,587,149 | A | * | 5/1986 | Murachi | 428/90 |
| 4,588,629 | A | * | 5/1986 | Taylor | 428/90 |
| 4,721,643 | A | * | 1/1988 | Harayama et al. | 428/90 |

(List continued on next page.)

FOREIGN PATENT DOCUMENTS

| | | | |
|---|---|---|---|
| DE | 24 27 712 | * | 12/1975 |
| EP | 333 685 | * | 9/1989 |
| JP | 06-42063 | * | 2/1994 |
| WO | WO 96/18782 | * | 6/1996 |
| WO | WO 97/08405 | * | 3/1997 |

OTHER PUBLICATIONS

Translation of DT 24 27 712 to Woog, Dec. 18, 1975.*

*Primary Examiner*—Cheryl A. Juska
(74) *Attorney, Agent, or Firm*—McDonnell Boehnen Hulbert & Berghoff

(57) ABSTRACT

The invention refers to a method of floor laying and underlay and surface material for this. According to the invention a coating of fiber flock on the underlay as well as on the underside of the floor surface material is utilized. Hereby is achieved partly that the need of glueing of floor material is eliminated and partly to provide a floor underlay that gives smoothing out, noise suppression and insulation as well as a fixing underlay for various floor materials so that these can be laid in larger or smaller portions and remain on site but simply can be adjusted when required.

18 Claims, 1 Drawing Sheet

Figure 1:
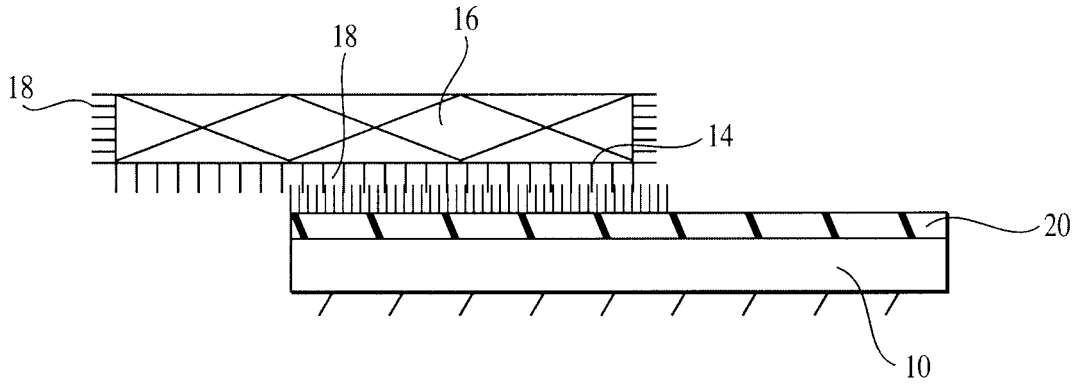

U.S. PATENT DOCUMENTS 4,754,589 A * 7/1988 Leth ..... 52/538
4,762,741 A * 8/1988 Hedley ..... 428/90
5,061,539 A * 10/1991 McDowell et al. ..... 428/90
5,194,308 A * 3/1993 Chang ..... 428/44
5,238,721 A * 8/1993 Nakazawa ..... 428/44
5,403,638 A * 4/1995 Yanagizawa et al. ..... 428/90
5,418,027 A * 5/1995 Conboy ..... 428/90
5,941,047 A * 8/1999 Johansson ..... 52/747.1
6,029,416 A * 2/2000 Andersson ..... 52/592.1

* cited by examiner

METHOD OF FLOOR LAYING AND FLOCKED UNDERLAY AND FLOOR MATERIAL TO BE USED WITH THE METHOD

This application is a continuation, of application Ser. No. 08/617,902 filed on Mar. 15. 1996, now abandoned which is a Continuation of PCT/SE94/00868 filed Sep. 16, 1994.

STATE OF THE ART

At floor laying glue is frequently used to fix floor mats to the underlay, which constitutes a health problem in connection with the floor laying and a period of time thereafter, and causes much work in connection with relaying of mats, since the glue frequently remains with portions of the floor mat or conveys portions of the floor underlay at the removal of the mat. For instance when laminate floors are layed frequently an underlay in the form of grey-rag-board or a board with cork scraps or a thin cellular plastic material is used in order to even roughness in the underlay and give a less rigid underlay which gives some elasticity, sound damping and insulation.

TECHNICAL PROBLEM

The problem that is solved by the present invention is to eliminate the need of glueing floor material and to provide a floor underlay that gives smoothing out, noise suppression and insulation as well as a fixing underlay for various floor materials so that these can be laid in larger or smaller portions and remain on site but simply can be adjusted required or being changed.

PRIOR ART

In connection with gymnastics mats and the like, separated into several smaller sections, fibre flock has been used on the undersides of the mats and on an underlay in order to make the mats to remain on site during exercises and at intervals be able to be removed, which is evident from DE A1 24 27 712. However, in this document nothing is disclosed that gives an indication about using corresponding method to eliminate glueing in connection with a durable laying of floor material of hard or semi-solid type in order to form a regular flooring.

The Drawing:

FIG. 1 is a cross section of one embodiment of a floor, underlay and surface material.

THE SOLUTION

According to the present invention one has therefore provided the floor underlay wholly or partly with fibre flock on the surface facing upwards. The surface material of the floor in a corresponding way is provided with fibre flock on the underside. According to the invention these materials are utilized at the floor laying, whereby the above stated problem is solved.

The floor underlay 10 may be constituted by the existing underlay in the form of fibre boards, boards, concrete floor or other which after necessary levelling is directly coated by an adhesive in which the fibers are applied by some known method which makes the majority of the fibers to be fastened in the main perpendicularly from the underlay, for instance by means of an electrostatic method. Such a coating can also be provided on a previous flooring to be covered.

Alternatively, a foil, board or slabs which wholly or partly has been coated with fibre flock, is put on the floor underlay whereby the surface provided with the fibre flock is put upwards. The support material thus produced in this manner can be provided an rolls or as slabs.

The surface material can be constituted by practically all available floor materials, such as plastic and linoleum mats, laminates and ceramic material.

Since the underside 14 of the surface material 16 has been coated with fibre flock 18, as shown in FIG. 1, this will attach to the fibers 20 of the underlay 10 and the surface material 16 will remain on site without the need of glueing. Even one or several of the edge surfaces of the surface material 16 may be coated with fibre flock 18, whereby for instance ceramic slabs, wood or laminate may obtain fixation to each other not only along the plane of the underlay 10 but also at the vertical plane. The fibre flock 18 thereby can complete or wholly replace joining by glue and other materials for joints.

The sides coated with fibre flock of the underlay as well as the surface material can be coated in Its entirety. It is also possible that either or both only partially is coated by fibre flock without deteriorating the function according to the present invention.

The method to cover a surface with fibre flock is well known. A common method resides in that a surface first is coated with am adhesive whereafter electrically charged fibers may land in the adhesive and stick there. The adhesive is frequently a two component resin glue and the fibers are generally synthetic fibres of for instance polyamide. The fibers which may be considered for the present invention are however not limited to some special type, but even for instance carbon fibres, glass fibre or the like may be considered. There are also other methods to cover a surface with fibre flock without use of electrically charged fibers which cam be utilized in connection with the present invention.

In a preferred embodiment of the present invention a large amount of fibers is utilized which at electrostatic application to a major part will be attached perpendicularly against the underlay. The fibre density can amount to 50–300 fibers per square mm, preferably more than 150 fibers per square mm, with a fibre thickness less than 0,1 mm, preferably less than 0,05 m and a length amounting to 0,5–5 mm, preferably less than 3 m.

The invention is not limited to the embodiments mentioned above but can be varied in different ways within the scope of the patent claims.

What is claimed is:

1. A method for coating of an underlay surface with a surface material comprising:

applying a fiber flock to said underlay surface, wherein said underlay surface becomes at least partly covered with fiber flock;

applying a fiber flock to an underside surface of said surface material, wherein the underside surface of said surface material becomes at least partly covered with fiber flock;

applying a fiber flock to at least one side edge of said surface material, wherein the at least one side edge of said surface material becomes at least partly covered with fiber flock; and attaching said fiber flock of said underside surface with said fiber flock of said underlay surface and attaching said fiber flock of said at least one side edge of said surface material with fiber flock of a second surface material, thereby fixing the surface material with the underlay surface in a direction along a plane of the underlay surface and along a plane vertical to the underlay surface, where said step of attaching follows said steps of applying.

2. The method according to claim 1, wherein said fiber flock is comprised of synthetic fibers which are applied in an adhesive by an electrostatic application method, wherein said adhesive is in direct contact with the underlay surface or the underside of the surface material.

3. The method according to claim 1, wherein the underlay surface and the underside of the surface material are wholly covered with fiber flock.

4. A flooring system comprising:

a first surface portion having fiber flock on at least a portion of one surface and on at least a portion of one side edge;

a second surface portion having fiber flock on at least a portion of one side edge;

an underlay material, to be placed between an underlay surface and the first surface portion, the underlay material comprising:

a shaped support material in the form of a sheet or a plate with a first side and a second side; and a fiber flock, the fiber flock covering at least part of the first side of the support material, the fiber flock being affixed to the shaped support material, wherein the fiber flock for the underlay material connects to the fiber flock on the one surface of the first surface portion and wherein the support material is in contact with the underlay surface, and wherein the fiber flock for the side edge of the first surface portion connects to the fiber flock on the one side edge of the second surface portion.

5. The underlay material according to claim 4, wherein the support material is selected from the group consisting of plastic material, foil, boards, slabs, and paper.

6. The underlay material according to claim 4, wherein the first side of the support material is partly covered with fiber flock.

7. The underlay material according to claim 4, wherein said fiber flock is comprised of synthetic fibers which are applied in an adhesive by an electrostatic application method, wherein said fibers have a length of between 0.5 and 5 mm and are applied at a density amounting to 50–300 fibers per square mm, and wherein the adhesive is in direct contact with the support material.

8. The floor surface material according to claim 4, wherein the underlay material provides for noise suppression.

9. A floor surface material, intended for coating of an underlay surface or an underlay material, the floor surface material comprising:

an upper wearing surface;

an underside surface; and at least one side edge surface separating the upper wearing surface from the underside surface, wherein the underside surface Is at least partly covered with a fiber flock, and wherein at least one of the side edge surfaces is at least partially covered with fiber flock.

10. The floor surface material according to claim 9, wherein the upper wearing surface is selected from the group consisting of wood, plastic, linoleum and ceramic slabs.

11. The floor surface according to claim 9, wherein the underside surface is wholly covered with fiber flock.

12. The floor surface material according to claim 9, wherein said at least one side edge surface is wholly covered with fiber flock.

13. The floor surface according to claim 9, wherein the fiber flock is comprised of synthetic fibers which are applied in an adhesive by an electrostatic application method, wherein said adhesive is in direct contact with the underside surface.

14. The floor surface according to claim 13, wherein said fibers have a length of between 0.5 and 5 mm and are applied at density amounting to 50–300 fibers per square mm.

15. The floor surface according to claim 14, wherein the fibers have a length of between 0.5 and 3 mm and are applied at a density amounting to 150–300 fibers per square mm.

16. The floor surface according to claim 10, wherein the fiber flock is comprised of synthetic fibers which are applied in an adhesive by an electrostatic application method, wherein said adhesive is in direct contact with the underside surface.

17. The floor surface according to claim 11, wherein the fiber flock is comprised of synthetic fibers which are applied in an adhesive by an electrostatic application method, wherein said adhesive is in direct contact with the underside surface.

18. The floor surface according to claim 9, wherein the fiber flock is comprised of synthetic fibers which are applied in an adhesive by an electrostatic application method, wherein said adhesive is in direct contact with the underside surface.

* * * * *

UNITED STATES PATENT AND TRADEMARK OFFICE

CERTIFICATE OF CORRECTION

PATENT NO. : 6,365,258 B1
DATED : April 2, 2002
INVENTOR(S) : Alm

It is certified that error appears in the above-identified patent and that said Letters Patent is hereby corrected as shown below:

Column 1,
At the beginning of line 31, please add -- when --
Line 31, please delete “changed” and substitute -- exchanged --

Column 2,
Line 3, please delete “an” and substitute -- on --
Line 19, please delete “Its” and substitute -- its --
Line 25, please delete “am” and substitute -- an --
Line 43, please delete “3 m.” and substitute -- 3 mm. --

Column 4,
Line 9, please delete “Is” and substitute -- is --

Signed and Sealed this

Seventh Day of January, 2003

JAMES E. ROGAN
*Director of the United States Patent and Trademark Office*